US005085906A

United States Patent [19]

Ast et al.

[11] Patent Number: 5,085,906

[45] Date of Patent: Feb. 4, 1992

[54] ADHESIVE LABEL FOR ADHERING TO A CONTAINER AND CONTAINERS MADE THEREWITH

[75] Inventors: Hans-Peter Ast, Brannenburg; Eberhard Paech, Holzkirchen; Werner Amberger, Munich, all of Fed. Rep. of Germany

[73] Assignee: Zweckform Etikettiertechnik GmbH, Holzkirchen, Fed. Rep. of Germany

[21] Appl. No.: 429,646

[22] Filed: Oct. 31, 1989

[30] Foreign Application Priority Data

Nov. 9, 1988 [DE] Fed. Rep. of Germany ..... 3838027

[51] Int. Cl.[5] ..... G09F 3/00

[52] U.S. Cl. ..... 428/36.92; 40/299; 40/638; 283/81; 428/343; 428/906

[58] Field of Search ..... 428/34.1, 36.92, 40, 428/343; 40/299, 638; 283/81

[56] References Cited

U.S. PATENT DOCUMENTS

| | | | |
|---|---|---|---|
| 3,813,801 | 6/1974 | Vander Schaaf | 40/306 |
| 3,995,087 | 11/1976 | DeSanzo | 428/40 |
| 4,264,657 | 4/1981 | Tollette | 428/34.2 |
| 4,273,816 | 6/1981 | Tollette | 428/34.2 |
| 4,552,789 | 11/1985 | Winchell | 428/132 |
| 4,552,789 | 11/1985 | Winchell | 428/132 |
| 4,764,405 | 8/1988 | Bauman et al. | 428/36.6 |
| 4,801,514 | 1/1989 | Will et al. | 40/299 X |
| 4,837,956 | 6/1989 | Dolence | 428/200 X |
| 4,911,994 | 3/1990 | Will et al. | 40/638 X |
| 5,032,477 | 7/1991 | Will et al. | 40/638 X |

FOREIGN PATENT DOCUMENTS

| | | |
|---|---|---|
| 0208261 | 1/1987 | European Pat. Off. . |
| 0286222 | 10/1988 | European Pat. Off. . |
| 1586625 | 4/1970 | Fed. Rep. of Germany . |
| 3430162 | 2/1986 | Fed. Rep. of Germany . |
| 8710305.2 | 11/1987 | Fed. Rep. of Germany . |
| 8904414.2 | 5/1989 | Fed. Rep. of Germany . |
| 1154164 | 6/1969 | United Kingdom . |

*Primary Examiner*—Henry F. Epstein
*Attorney, Agent, or Firm*—Foley & Lardner

[57] ABSTRACT

The invention relates to an adhesive label for adhering to a container of PP, intended preferably for receiving foodstuffs and preferably being stackable, having, on the underside, an adhesive layer and, on the upper side, a PP base layer provided with an imprint and on the upper side of the PP base layer a PP film has been adhered by a laminating adhesive.

12 Claims, 1 Drawing Sheet

ADHESIVE LABEL FOR ADHERING TO A CONTAINER AND CONTAINERS MADE THEREWITH

BACKGROUND OF THE INVENTION

The present invention relates to an adhesive label for adhering to a container, and to containers made with these labels. The label has on its underside an adhesive layer, on its upper side an imprint, and a film stuck to the upper side of the film layer by a laminating adhesive.

An adhesive label of this general kind is known from DE-PS 34 30 162. No mention is made in this document about the material of the film layer and the film.

It is known from DE-GM 89 04 414 and according to U.S. Pat. No. 3,813,801 that a composite film may be provided with a layer of foamed polyurethane (PU).

An opaque, foamed label body of polypropylene (PP) which has a thickness of 80 μm is known from DE-GM 89 04 414.

Adhesive layers of an acrylic dispersion are known from the general prior art.

SUMMARY OF THE INVENTION

It is an object of the invention to provide an adhesive label which has on its underside an adhesive layer, on its upper side an imprint, and a film stuck to the upper side of the film layer by a laminating adhesive, and which is suitable for adhering to a container of PP intended preferably for receiving foodstuffs and preferably being stackable. It is a further object of the invention to provide an improved label which conforms to the legislation for foodstuffs (in particular to Sections 5, 30 and 31 of the German Federal Law for Foodstuffs), but which may be perfectly and attractively provided with an imprint.

A further object of the invention resides in a container, preferably a stackable food container, made with the label according to the invention.

In accomplishing the foregoing objects, there has been provided according to one aspect of the present invention an adhesive label for applying to a container, comprising a base layer, which includes on its underside an adhesive layer and on its upper side an imprint; and a film adhered to the upper side of the base layer by means of a laminating adhesive, wherein the base layer and the film consist essentially of polypropylene.

In accordance with another aspect of the invention, there has been provided a container, comprising a container made of polypropylene and having adhered thereto an adhesive label as defined above.

Further objects, features and advantages of the present invention will become apparent from the detailed description of preferred embodiments which follows, when considered together with the attached drawing.

DETAILED DESCRIPTION OF THE PREFERRED EMBODIMENTS

The adhesive labels according to the invention allow a problem-free stacking of stackable containers, for instance before they are filled.

The imprint on the upper side of the PP film layer is protected by the PP film so that it cannot be damaged, especially when the containers are being stacked or handled. The covering PP film is preferably glossy transparent. The side of the PP film layer provided with the imprint is preferably opaque, possibly white.

When using a PP film with an embedded imprint, there is virtually no risk of soiling the inner side of the container, in particular when it is a cup-shaped container. The danger that germs might be formed and transferred onto the inner side of the containers, in particular of stacked cup-shaped containers, is thus also reduced to a minimum.

The preferred embodiments of the invention facilitate the manufacturing and processing of the adhesive label, especially printing, punching and lifting off of the grid from the carrier band and the lifting off of the adhesive label from the carrier band by machine, while at the same time achieving sufficient stability of the adhesive label despite the required flexibility of the adhesive label. Adhesive labels having a film layer comprising a foamed PP core covered on both sides by oriented polypropylene (OPP) layers not only comply with the above requirements but can also be applied without forming creases. Such film layers may be manufactured without difficulty with a surface energy of over 38 dyn for the printed side and of over 36 dyn for the adhesive side. Coextrusion is an especially simple way of manufacturing the film layer of this type.

The PP film on the upper side also facilitates the removal (lifting off) of the adhesive label from the carrier by machine.

The adhesive label is largely water-proof, grease-proof and resistant against fats and oils. In particular, the foamed PP core is not hygroscopic.

The adhesive label is tear-proof. The PP film layer with a foamed core also significantly improves the effectiveness of the thermal insulation of the container.

It is also of special significance that the container and the adhesive label substantially consist of the same synthetic material, namely PP, which increases its waste value by making the container easier to recycle.

The invention is hereinafter described with reference to a preferred embodiment and to the attached drawings.

Figure 1:
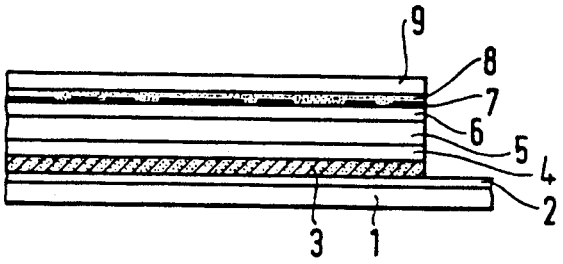
FIG. 1 is a section of a carrier band with an adhesive label attached thereto.

FIG. 1 shows a carrier 1, preferably of highly compressed Kraft paper with a weight per unit area of 65 to 90 g/cm$^2$, provided, on the upper side, with an adhesive layer 2 of silicone. Above layer 2 is a detachable adhesive label having a core made up from layers 4, 5, 6, with the series with layer 4 being white OPP, layer 5 being white, foamed PP, and layer 6 being white OPP of a total thickness of from about 40 to 80 μm, preferably about 40 to 60 μm. On its underside, core 4, 5, 6 has an adhesive layer 3 of an acrylic dispersion. On its upper side, the film layer 4, 5, 6 has an imprint 7 in a color which is not harmful to foodstuffs. Imprint 7 is covered by a glossy transparent film 9 of OPP preferably of a thickness of about 12 to 15 μm, said film being stuck to imprint 7 and thus to the core 4, 5, 6 by means of a laminating adhesive 8.

Figure 2:
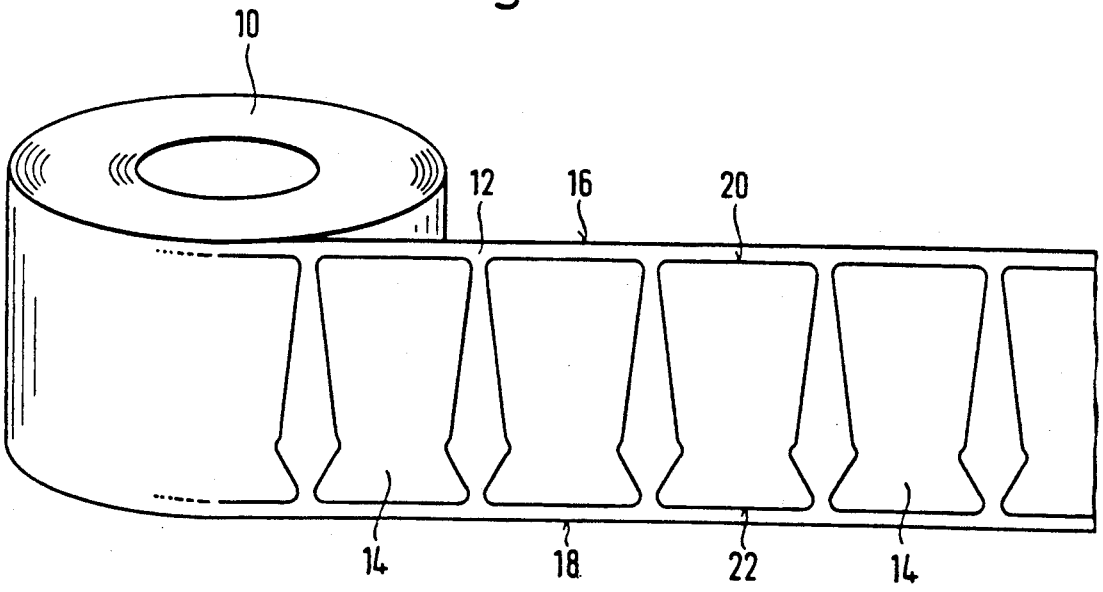
FIG. 2 shows adhesive labels on a carrier band wound into a roll.

FIG. 2 shows a roll 10 with a carrier band 12 corresponding to carrier 1, which carriers adhesive labels 14 constructed according to FIG. 1. Roll 10 is wound with a uniform tension. The edges 20, 22 of the labels 14, which face edges 16, 18 of the carrier band 12, have the same length and the same spacing from the edges 16, 18. The uniform winding tension of the roll 10 and the described position of the adhesive labels 14 on the carrier band 12 as well as the measurements thereof allow for a proper, automatic peeling off of the adhesive labels 14 from the carrier band 12 and an exact positioning of the adhesive labels 14 on the containers.

What is claimed is:

1. Adhesive label for applying to a container, comprising a base layer, which includes on its underside an adhesive layer and on its upper side an imprint; and a film adhered to the upper side of the base layer by means of a laminating adhesive, wherein the base layer comprises a foamed polypropylene core layer and a pair of polypropylene layers, the foamed polypropylene layer being covered on both sides with the polypropylene layers, and wherein and the film consists essentially of polypropylene.

2. Adhesive label according to claim 1, wherein the polypropylene layers surrounding the core layer comprise oriented polypropylene layers.

3. Adhesive label according to claim 2, wherein the film layer has a thickness of from about 40 to 80 μm.

4. Adhesive label according to claim 1, wherein the base layer has a thickness of from about 40 to 80 μm.

5. Adhesive label according to claim 1, wherein the film consists essentially of oriented polypropylene.

6. Adhesive label according to claim 5, wherein the film has a thickness of from about 12 to 15 μm.

7. Adhesive label according to claim 1, wherein the film has a thickness of from about 12 to 15 μm.

8. Adhesive label according to claim 1, wherein the adhesive layer comprises an acrylic dispersion.

9. Adhesive layer according to claim 1, wherein at least one of the polypropylene layers surrounding the core layer consists essentially of oriented polypropylene.

10. A container, comprising a container made of polypropylene and having adhered thereto an adhesive label, the adhesive label comprising a base layer, which includes on its underside an adhesive layer and on its upper side an imprint and a film adhered to the upper side of the base layer by means of a laminating adhesive, wherein the base layer comprises a foamed polypropylene core layer and a pair of polypropylene layers, the foamed polypropylene layer being covered on both sides with the polypropylene layers, and wherein the film consists essentially of polypropylene.

11. A container according to claim 10, wherein the container is a foodstuff container.

12. A container according to claim 11, wherein the container is stackable.

* * * * *